United States Patent [19]

Schwartz

[11] 4,073,031

[45] Feb. 14, 1978

[54] VACUUM CLEANER NOZZLE WITH RETRACTABLE BRUSH

[75] Inventor: Osten Schwartz, Varmdo, Sweden

[73] Assignee: Aktiebolaget Electrolux, Stockholm, Sweden

[21] Appl. No.: 666,581

[22] Filed: Mar. 15, 1976

[30] Foreign Application Priority Data

Mar. 26, 1975 Sweden ..... 7503538

[51] Int. Cl.[2] ..... A47L 9/02

[52] U.S. Cl. ..... 15/373

[58] Field of Search ..... 15/368, 371, 373

[56] References Cited

U.S. PATENT DOCUMENTS 1,348,585 8/1920 Rosenfield ..... 15/373 X 3,727,263 4/1973 Johannsson ..... 15/373

3,952,363 4/1976 Lindman ..... 15/373

FOREIGN PATENT DOCUMENTS 2,341,580 3/1974 Germany ..... 15/373

*Primary Examiner*—Christopher K. Moore

*Attorney, Agent, or Firm*—Alfred E. Miller

[57] ABSTRACT

A vacuum cleaner nozzle having a hollow bottom part and a movable section provided with a brush that is vertically movable between a floor-engaging position and a retracted position that is out of contact with the floor. The movable section is operated by a pivotable button protruding through the upper surface of the nozzle, said button being turnable on a shaft and capable of being locked in position.

4 Claims, 4 Drawing Figures

VACUUM CLEANER NOZZLE WITH RETRACTABLE BRUSH

BACKGROUND OF THE INVENTION

Vacuum cleaner nozzles are known in which a part carrying a brush is movable in a substantially vertical direction and that is operated by means of an externally located button for either foot or manual operation. However, in the known arrangements the construction which transmits movement from the actuating button to the brush-carrying section of the vacuum cleaner nozzle comprises a number of linking parts, such as arms, which are journalled in the vacuum cleaner nozzle housing at several points. This constructional arrangement is rather complicated as well as expensive to produce.

It is therefore a principal object of the present invention to provide a vacuum cleaner nozzle with a retractable brush that functions in a completely acceptable manner yet is considerably simpler in construction and lower in cost of production.

A further object of the present invention is to provide an operating button on a shaft which is supported in vertical grooves in the walls of the vacuum cleaner nozzle. The button is further provided with a projection that moves in a separate groove, and in a predetermined position of the brush-carrying section is released from the groove and pivoted to engage an abutment surface, thus locking the section in that predetermined position.

In order that the invention will be more clearly understood it will now be disclosed in greater detail with reference to the accompanying drawings, in which.

BRIEF DESCRIPTION OF THE PREFERRED EMBODIMENTS

Figure 1:
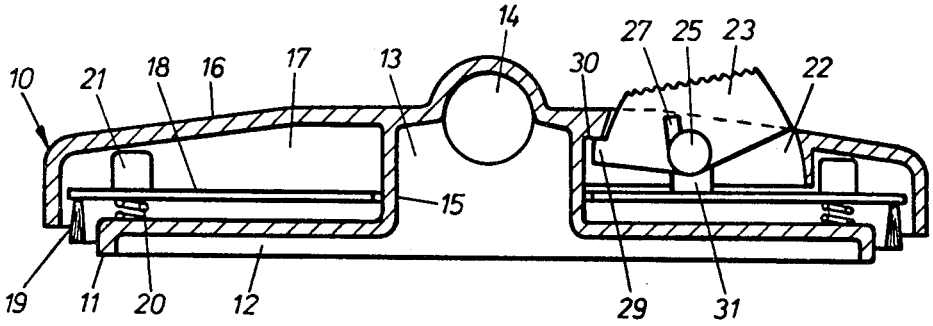
FIG. 1 is a vertical section taken through the vacuum cleaner nozzle with the brush-carrying section in the elevated position.
Figure 2:
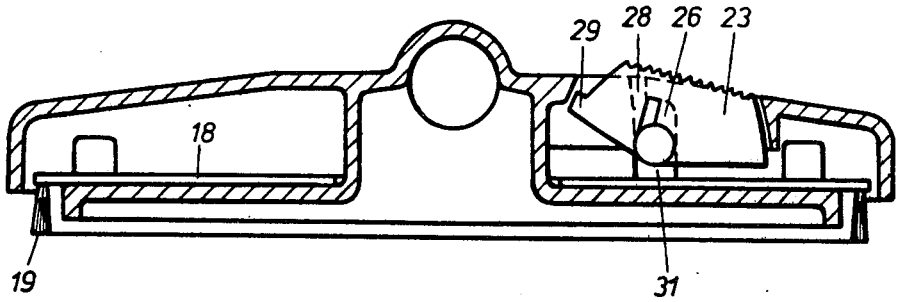
FIG. 2 is a vertical section similar to FIG. 1 with the brush-carrying section in the lowered position.

As seen in FIGS. 1 and 2, the vacuum cleaner nozzle is referred to by the reference numeral 10 and is provided with a stationary bottom part 11 which is hollow and communicates with an opening 14 that is so positioned as to form a connection between the vacuum cleaner nozzle 10 and the suction hose (not shown) of the vacuum cleaner. The bottom part 11 is adapted to be moved over a work surface for cleaning purposes, preferably a soft surface, such as a carpet or rug. The hollow bottom part 11 has an enlarged opening 12 which merges into a central inlet part 13 that communicates with the opening 14. As seen in FIGS. 1 and 2, the central inlet part 13 is surrounded by a wall 15 which together with the bottom part 11 and the upper part 16 of the nozzle encloses a space 17. The latter space accommodates a vertically movable plate 18 having a peripheral ring 19 of bristles.

In the normal condition of the vacuum cleaner nozzle the ring 19 of bristles is maintained in an extended or elevated position, as seen in FIG. 1 by means of the action of the compression springs 20 located in the hat-shaped portions 21 of the movable plate 18 and engaging the plate with one end thereof.

Figure 3:
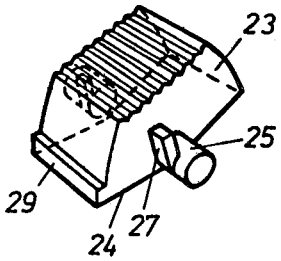
FIG. 3 is a perspective view of a push button carried by vacuum cleaner nozzle that can be operated manually or by foot.
Figure 4:
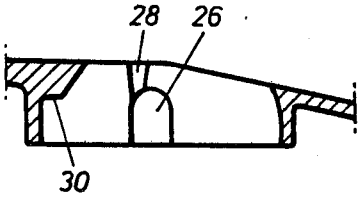
FIG. 4 is partial sectional view of a detail of the nozzle in which the push button shown in FIG. 3 is guided.

The upper surface of the nozzle 10 is provided with a hole 22 in which push button or operator 23 is located. The operator 23 has a v-shaped bottom surface 24 and a transverse shaft 25 (FIG. 3). The opposite ends of shaft 25 rest in vertical grooves 26 in the nozzle. The button or operator 23 has a projection above each end of the shaft 25. The projections 27 in the position shown in FIG. 1 lies in a corresponding recess 28 which is a continuation of the groove 26 which gradually increases in size toward the open end remote from the shaft. The operator 23 in addition has a ledge 29 that is adapted to co-act with a shoulder 30 on the nozzle housing.

As seen in FIGS. 1 and 2, the shaft 25 is held in a pillow block 31 which rests on movable plate 18.

In order to understand the functions of the elements described herein the operation of the present device is as follows: The operator 23, shown in FIG. 1, is depressed in order to shift the nozzle from the position shown in FIG. 1 to the position shown in FIG. 2. When the operator 23 is thus depressed the abutment point of the shoulder 30 and the ledge 29 of the operator serve as the first pivot point, whereby the operator 23, the pillow block 31 and the right hand end of the plate 18 move vertically downwards against the action of the spring 20. Therefore, in the area between the spring 20 and the peripheral ring 19 of bristles the right hand end of the plate 18 abuts the top surface of the bottom part 11. However, during continued depression of the operator 23 the point of engagement between the right hand end of the plate and the bottom part 11 serves as a rotational center for the continued movement of the plate, that is the downward movement of the left hand part of the plate 18. When the operator 23 has been sufficiently depressed, the projection 27 will come out of the recess 28 and the ledge 29 will become disengaged from the shoulder 30, as seen in FIG. 2, and the button 23 will then turn about a second pivot point, between shaft 25 and pillow block 31 and engage the projection with the upper rounded surface of the groove 26. It should be noted that the recess 28 is larger at its end remote from said shaft; thereby permitting pivotal motion of the projection about the first pivot point during the depressing of the button. This condition, as seen in FIG. 2, causes the ring of bristles 19 to be retracted to their downmost position and ready for use on a hard surface, such as a bare floor.

What is claimed is:

1. A vacuum cleaner nozzle having a fixed open bottom part facing the surface to be cleaned, a brush carrying plate in said nozzle which is movable relative to said fixed bottom part and is utilized for cleaning another type of work surface, yieldable means urging said movable plate away from said bottom part, an operator, means supporting said operator on said movable brush carrying plate, said operator co-acting with said movable brush carrying plate for moving the latter between a first retracted position and a second extended position, said operator being externally accessible through the top of said nozzle and being capable of pivotal movement, a ledge on said operator whereby when the latter moves said ledge co-acts with a shoulder of said nozzle, the point of abutment of said ledge on said shoulder functioning as a first pivot point of said operator thereby permitting the latter to pivot, a vertical groove in at least part of said nozzle walls, said operator being provided with a shaft which is supported in said vertical groove, said shaft being provided with at least one projection, a recess in said nozzle walls for accommodating said projection, and in the second position of said movable plate said projection is released from said recess as said projection and operator are pivoted about a second point to thereby engage said projection with an abutment surface in said vertical groove whereby said movable plate is locked in its second extended position.

2. A vacuum cleaner nozzle as claimed in claim 1 wherein said ledge in the second extended position of said movable plate is disengaged from said shoulder.

3. A vacuum cleaner nozzle as claimed in claim 1 wherein said operator is a foot-operated button.

4. A vacuum cleaner nozzle as claimed in claim 1 wherein said recess is larger at its end remote from said shaft to permit pivotal movement of the projection about said first pivot point during the initial movement of said operator toward said fixed bottom part.

* * * * *